US007892622B2

(12) United States Patent
Löcher et al.

(10) Patent No.: US 7,892,622 B2
(45) Date of Patent: Feb. 22, 2011

(54) METHOD FOR MANUFACTURING A TUFTED PRODUCT, TUFTED PRODUCT, AND USE THEREOF

(75) Inventors: Engelbert Löcher, Worms (DE); Norbert Goffing, Neunkirchen (DE); Ararad Emirze, Kaiserlautern (DE)

(73) Assignee: Carl Freudenberg KG, Weinheim (DE)

( * ) Notice: Subject to any disclaimer, the term of this patent is extended or adjusted under 35 U.S.C. 154(b) by 163 days.

(21) Appl. No.: 12/029,350

(22) Filed: Feb. 11, 2008

(65) Prior Publication Data

US 2008/0220199 A1 Sep. 11, 2008

(30) Foreign Application Priority Data

Feb. 12, 2007 (DE) ..... 10 2007 006 760

(51) Int. Cl.
*D05C 17/02* (2006.01)
*D05C 15/04* (2006.01)

(52) U.S. Cl. ..... 428/95; 112/410; 112/1; 112/475.08

(58) Field of Classification Search ..... 428/95, 428/96; 442/409, 411, 361, 362, 363; 112/410, 112/1, 475.08
See application file for complete search history.

(56) References Cited

U.S. PATENT DOCUMENTS

| | | | | | |
|---|---|---|---|---|---|
| 3,359,934 | A | * | 12/1967 | Schwartz et al. | 112/410 |
| 3,431,875 | A | | 3/1969 | Boultinghouse | |
| 3,551,229 | A | * | 12/1970 | Yazawa | 156/62.2 |
| 3,751,777 | A | | 8/1973 | Turmel et al. | |
| 3,788,364 | A | | 1/1974 | Dawbarn | |
| 3,940,302 | A | * | 2/1976 | Matthews et al. | 156/167 |
| 4,016,316 | A | | 4/1977 | Bohrn | |
| 4,131,704 | A | | 12/1978 | Erickson et al. | |
| 4,294,876 | A | * | 10/1981 | Camden et al. | 428/95 |
| 4,617,218 | A | | 10/1986 | Cadenhead, Sr. | |
| 4,842,915 | A | * | 6/1989 | Hartmann et al. | 428/95 |
| 4,906,520 | A | * | 3/1990 | Kumar | 442/186 |
| 5,660,910 | A | * | 8/1997 | Hoyt et al. | 428/95 |
| 5,766,735 | A | * | 6/1998 | Beyer et al. | 428/198 |
| 5,948,528 | A | | 9/1999 | Helms, Jr. et al. | |
| 6,740,385 | B2 | | 5/2004 | Gardner et al. | |
| 6,808,786 | B2 | * | 10/2004 | Theiss | 428/95 |
| 6,838,402 | B2 | * | 1/2005 | Harris et al. | 442/347 |
| 6,849,565 | B1 | * | 2/2005 | Gardner et al. | 442/35 |
| 2003/0166370 | A1 | * | 9/2003 | Harris et al. | 442/356 |
| 2004/0151870 | A1 | * | 8/2004 | Theiss | 428/95 |
| 2005/0142325 | A1 | * | 6/2005 | Veurink et al. | 428/95 |
| 2005/0147787 | A1 | * | 7/2005 | Bailey et al. | 428/95 |
| 2008/0017294 | A1 | * | 1/2008 | Bailey et al. | 156/72 |
| 2008/0116129 | A1 | * | 5/2008 | Oosterbroek et al. | 210/500.1 |

(Continued)

FOREIGN PATENT DOCUMENTS

| | | |
|---|---|---|
| DE | 19755014 | 1/1999 |

(Continued)

*Primary Examiner*—Cheryl Juska
(74) *Attorney, Agent, or Firm*—Grossman, Tucker, Perreault & Pfleger, PLLC

(57) ABSTRACT

The object of the invention is to provide a method which is as simple and economical as possible for manufacturing a tufted product, in particular a tufted top layer of a carpet, having improved nep adhesion properties. For this purpose splittable fibers are used which split on or in the region of the puncture site during tufting.

17 Claims, 5 Drawing Sheets

U.S. PATENT DOCUMENTS

| | | | | |
|---|---|---|---|---|
| 2009/0004943 | A1 * | 1/2009 | Locher et al. | 442/401 |
| 2009/0149102 | A1 * | 6/2009 | Locher et al. | 442/335 |

FOREIGN PATENT DOCUMENTS

| | | | |
|---|---|---|---|
| GB | 816185 | | 7/1959 |
| GB | 854335 | | 11/1960 |
| GB | 1399830 | | 7/1975 |
| WO | WO 2004022831 | A1 * | 3/2004 |

* cited by examiner

METHOD FOR MANUFACTURING A TUFTED PRODUCT, TUFTED PRODUCT, AND USE THEREOF

TECHNICAL FIELD

The invention relates to a method for manufacturing a tufted product, in particular a tufted top layer of a carpet produced thereby, and the use of a such a tufted product, in particular such a tufted top layer of a carpet.

BACKGROUND

A tufted carpet is manufactured by using so-called tufts or tufting, i.e., a technique for producing three-dimensional surfaces which functions according to the principle of a sewing machine.

In this process, tufting needles introduce a tuft yarn into a base material, the so-called tuft backing. The tufting needles mounted on a needle bar are positioned along the width of the base material, a nonwoven fabric, for example, and simultaneously pierce through the base material. Before the tufting needles return upward to their starting position, the introduced tuft yarn is secured to the underside of the base material by grippers, referred to as loopers. This results in loops or slings, so-called neps, which form the visible side (top layer) of the finished carpet.

Depending on the application, these loops may be cut during the tufting process, using special blades. This results in the velour carpet, which is preferred in particular in the automotive interior sector, where it accounts for more than 95% of the total use.

Frequently used as tuft backing are nonwoven fabrics made of thermoplastic polymers, for example polyethylene terephthalate (PET) fibers and/or polypropylene (PP) fibers, which are bonded by needling, spot welding, by use of a chemical binder, by means of binding fibers, or a combination of these bonding processes.

The use of exclusively spot-welded or exclusively binder-bonded nonwoven fabrics is disadvantageous because these fabrics are not particularly well suited for production of three-dimensional shaped articles due to their poor deformability, especially for use in the automotive field.

When conventional round fibers are used, the contact surface and the friction between the fibers used in the nonwoven fabric tuft backing and the tuft yarns is relatively small, so that the retention force for the tuft yarn, in particular for complex carpet surface structures such as cut-loop velour or looped grades, or crossover velour grades (with offset pile knots), is frequently insufficient. The tuft yarn introduced into the tuft backing after penetration and withdrawal of the tufting needle may lose its intended position, i.e., the height or location of the nep, for example, as the result of the combination of slight variations in tuft backing density, yarn tension, and yarn quality, and in some cases the tuft yarn may even be pulled from the tuft backing. In both cases this may result in very noticeable defects and undesirable design flaws in the top layer of the tufted carpet.

The known conventional nonwoven fabrics having round fibers and used as tuft backing therefore do not meet the various requirements for particularly good adhesion of the tufted tuft yarns in the tuft backing, and are not always satisfactory for a defect-free tuft pattern in the top layer of the carpet.

It is known from U.S. Pat. No. 6,740,385 B2 that pattern uniformity and dimensional stability, in particular stability against deformation during and after the tufting process, may be improved by bringing tightly woven fabrics into contact with a uniform nonwoven fabric layer made of staple fibers and fusing them together.

SUMMARY

The object of the invention is to provide an alternative method, which is as simple and economical as possible, for manufacturing a tufted product, in particular a tufted top layer of a carpet, having improved nep adhesion properties. A particular aim is to use the top carpet layer produced according to the method in the automotive interior sector or the commercial sector. The term "commercial sector" means that the carpet is designed for high- to extremely high-stress areas, especially in offices, hotels, airports, and/or hospitals.

The stated object is achieved according to the invention by a method for manufacturing a tufted product wherein splittable fibers are used which split on or in the region of the puncture site during tufting and a tufted product manufactured according to that method.

According to the method for manufacturing a tufted product, in particular a tufted top layer of a carpet, splittable fibers, in particular as tufted backing in the form of a nonwoven fabric, are used which split on or in the region of the puncture site during tufting.

In this context, fibers are understood to mean staple fibers or continuous fibers, referred to as filaments. The fibers may also be combined to form fleeces, in particular bonded fleeces, for nonwoven fabrics.

The mechanical stress of penetration by the tufting needles into the fibers of the tuft backing causes the splittable fibers to split.

As a result, the tuft backing locally felts, in a manner of speaking, at the puncture site due to the separation or dissociation of the splittable fibers into individual filaments or segments, causing the specific fiber surface in this region of the tuft backing to enlarge, thereby also increasing the static friction and sliding friction between the fibers of the tuft yarn and the tuft backing.

This ensures that the tuft yarn introduced by the tufting needle adheres particularly well in the tuft backing, and prevents the tuft yarn from being accidentally pulled out.

The type of fibers used thus allows the formation of particularly stable loops or neps of tuft yarn, and the formation of a tuft pattern in the carpet which in particular is free of defects.

The subclaims state advantageous refinements of the subject matter of the invention.

Splittable fibers are preferably used in a proportion of 10 to 100% by weight.

In one preferred embodiment of the method a mixture of splittable and nonsplittable fibers is used. The ratio of splittable to nonsplittable fibers may be adjusted as a function of the carpet or tuft specifications. For comparatively simple tuft specifications, such as for velour products which are tufted in a straight pattern without offset, the proportion of splittable fibers is preferably less than or equal to 50% by weight. For comparatively complex tuft specifications, for example cut-loop or crossover velour products, the proportion of splittable fibers is preferably less than or equal to 75% by weight.

At least two mutually incompatible polymer components are advantageously used as splittable fibers.

At least one polymer component preferably has a lower weight proportion than the other polymer component(s).

In one preferred embodiment of the method, at least one polymer component has a weight proportion of less than or equal to 20% by weight, preferably less than or equal to 10% by weight, particularly preferably less than or equal to 5% by weight, very particularly preferably less than or equal to 3% by weight, relative to the total weight of the fibers.

As a result of the minimal weight proportion of one component, in particular a comparatively expensive polymer, the manufacturing costs may be reduced for the tufted products, in particular the tufted top layer of a carpet. A further possibility for cost savings lies in the fact that, due to the improved nep adhesion, the quantity of setting agents or primers usually used in the carpet industry for final setting of the carpet yarn may be reduced. Furthermore, as the result of decreasing the required quantity of setting agents or primers, for example latex compounds, odors and emissions may be reduced, in particular in closed spaces such as the passenger compartment of an automobile, for example.

In addition, undesirable properties of one component, such as low temperature or flame resistance, may be reduced by using only a minimal proportion of this component. Significantly decreasing a proportion of polymer may also enhance the capability for recycling.

In addition, by use of specific weight proportions of the polymers used, the desired properties of the tufted products, in particular the tufted top layer of a carpet, may be precisely controlled.

In a further preferred embodiment of the method, a polymer component with a lower melting temperature is used as the polymer component having a lower weight proportion.

At least one polymer component, preferably a polymer component having a lower weight proportion than the other polymer component(s), is advantageously used as adhesive or binding component, the melting temperature of this polymer component being at least 10° C., preferably at least 20° C., below the melting temperature of the other polymer component(s).

By use of these measures the properties of the tufted product thus manufactured, in particular the tufted top layer of a carpet, may be influenced, and in particular the degree of bonding or softness thereof may be adjusted.

The nonsplittable fibers are preferably selected from mono-, bi-, or multicomponent fibers, and/or from mixtures of such fibers.

Furthermore, the fibers are preferably selected from thermoplastic polymers, in particular polyesters, preferably polyethylene terephthalate (PET), or polyolefins, preferably polyethylene (PE) and/or polypropylene (PP), or polylactates and/or polyamides (PA), preferably polyamide 6.6 (PA6.6), and/or copolymers derived therefrom.

For splittable bicomponent fibers, combinations of mutually incompatible polymers are selected, preferably combinations of polyethylene terephthalate (PET) and polypropylene (PP), polyethylene terephthalate (PET) and polyamide (PA), preferably polyamide 6 or polyamide 6.6, and/or polypropylene (PP) and polyethylene (PE).

Fibers are selected which advantageously have a titer in the range of 5 to 20 dtex, preferably 5 to 12 dtex.

To strengthen the nep adhesion, fibers are selected which preferably have circular or noncircular cross-sectional shapes. In contrast to circular fibers, noncircular cross-sectional shapes result in increased fiber-fiber friction, thereby providing improved nep adhesion as the result of better mutual adhesion.

Furthermore, the fibers selected preferably have a solid or hollow design.

In one preferred embodiment of the method for manufacturing a top layer of a carpet, the fibers are used in the form of a fleece or nonwoven fabric, in particular a spun fleece or spun nonwoven fabric, as tuft backing.

To form adhesive points between the tuft yarn and at least one polymer component, in particular for the split fibers, the top layer of carpet is preferably subjected to heat treatment after tufting. In this manner the nep adhesion is further enhanced.

The tufted products manufactured according to the invention, in particular the tufted top layer of a carpet, are preferably used in the automotive interior sector and/or the commercial sector, especially in offices, hotels, airports, and/or hospitals.

BRIEF DESCRIPTION OF THE DRAWINGS

The subject matter of the invention is explained in greater detail with reference to one example.

The scanning electron micrographs allow the fiber/fleece cross sections and the surface structure to be recorded at appropriate magnifications. The scanning electron micrographs were produced using a JEOL JSM-6480LV low-pressure scanning electron microscope at an acceleration voltage of 20 kV.

DETAILED DESCRIPTION

According to the invention, splittable fibers in particular in the form of a nonwoven fabric were used as tuft backing for manufacturing the tufted product, in particular the tufted top layer of a carpet.

Manufacture of a Nonwoven Fabric Containing Splittable Fibers

A nonwoven fabric containing splittable fibers in a proportion of 100% by weight was manufactured as follows, by way of example.

a) Flat product

The following were used: commercially available polyethylene terephthalate (PET) having an intrinsic solution viscosity of 0.65, and polypropylene (PP) having a melt flow index (MFI) value of 19 g/10 min (230° C./2.16 kg), in a weight ratio of 95:5.

These materials were spun into PET/PP pie fibers, in particular having four segments each of PET and PP, and were deposited on a belt screen having a belt speed of 13 m/min.

The spun filaments had a titer value of 9.5 dtex, with strength values of 29 mN/dtex and elongation values of 135% (DIN 53812 and DIN 53816).

b) Prebonding

The flat products thus produced were prebonded by calendering, using one smooth and one rough roller at a surface temperature of 100° C. and a cylinder pressure of 16 bar.

c) Bonding

The flat product then underwent final bonding in an air dryer at an air temperature of 225° C.

d) Finishing

An aqueous polydimethlysiloxane emulsion was then applied as textile auxiliary agent (softener), using a sprayer, for example, with a solids concentration of 5% by weight and moisture absorption of 7% (0.35% by weight softener relative to the nonwoven fabric weight).

The nonwoven fabric finished by means of the softener was dried in an air dryer at an air temperature of 100° C.

A nonwoven fabric comprising splittable fibers was obtained which had a weight of 115 g/m$^2$.

Figure 1:
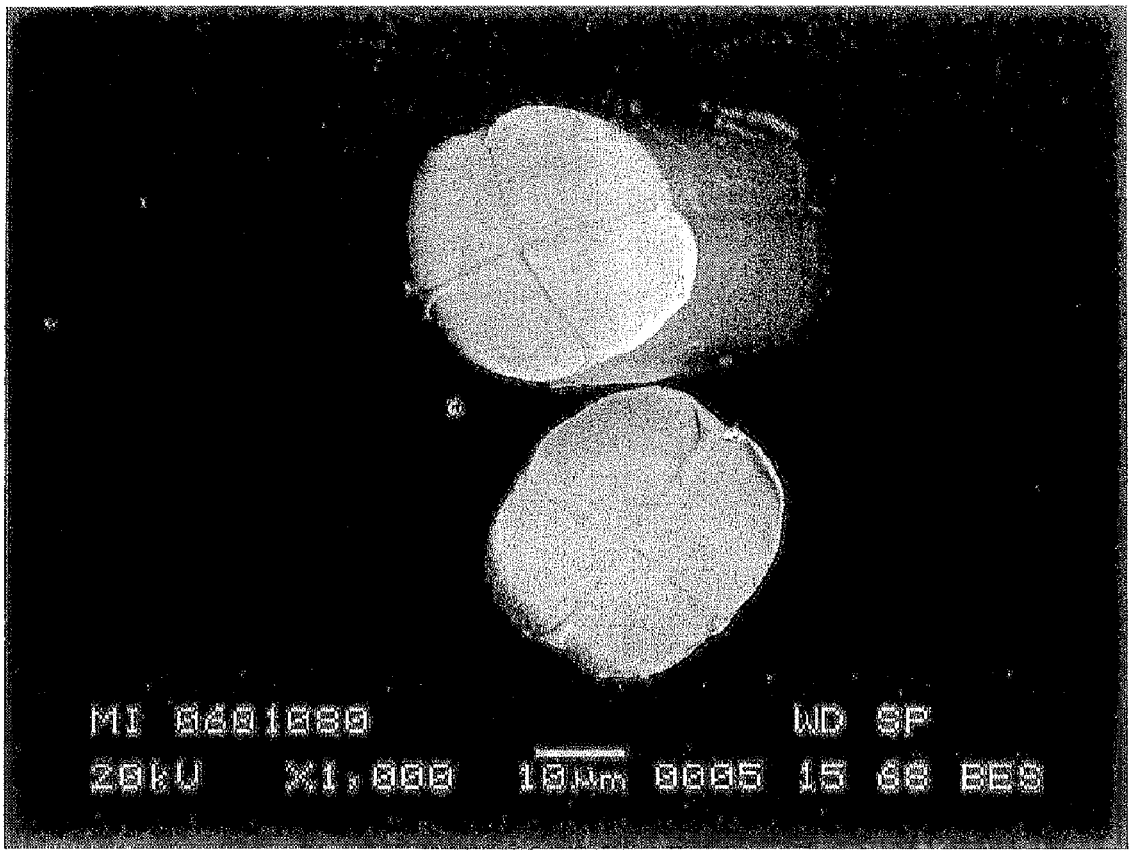
FIG. 1 shows a scanning electron micrograph of the cross section of segmented PET/PP pie fibers in a weight ratio of 95:5, directly after spinning, in 1000× magnification.

FIG. 1 shows that very good, i.e., distinct, segmentation is present between the PET segments and PP segments of the spun splittable PET/PP pie fibers, despite the low weight proportion of polypropylene (PP).

Figure 2:
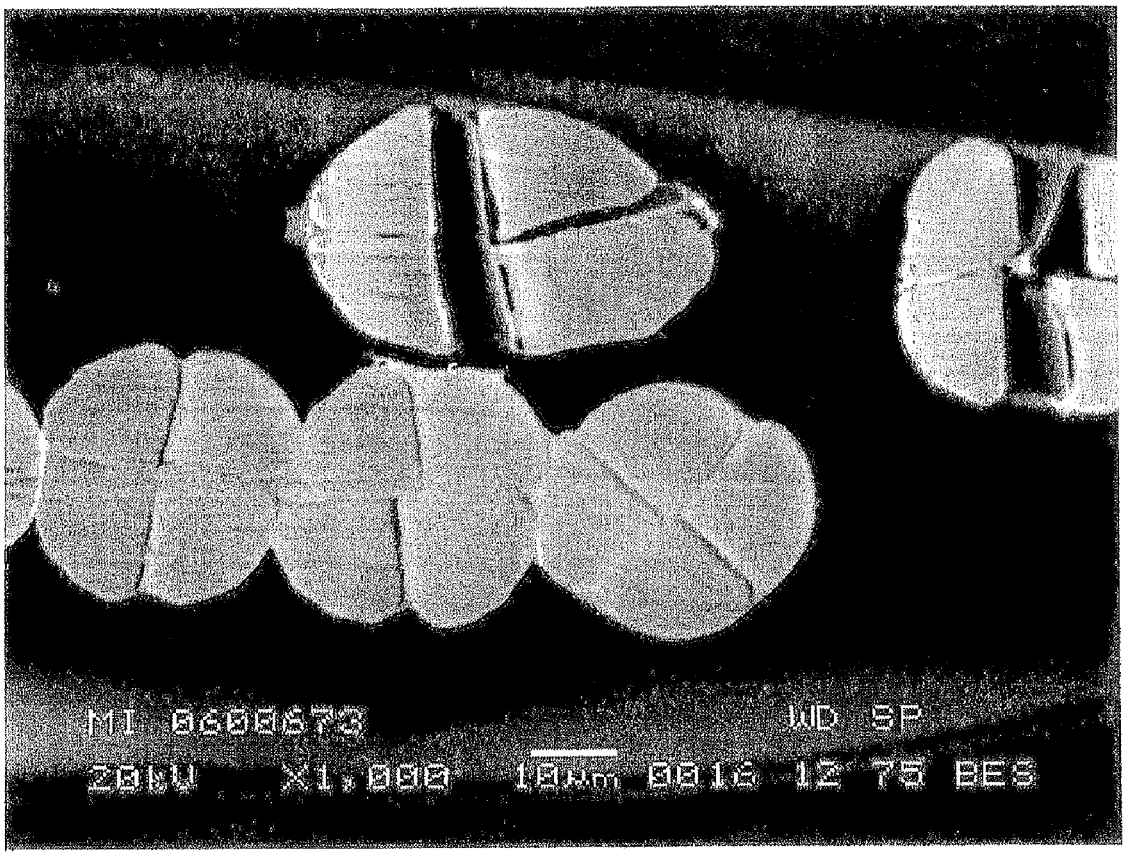
FIG. 2 shows a scanning electron micrograph of the cross section of segmented PET/PP pie fibers in a weight ratio of 95:5, after bonding, in 1000× magnification.

FIG. 2 shows that after the segmented PET/PP pie fibers are bonded, slight presplitting of the spun splittable PET/PP pie fibers of the nonwoven fabric is present as a result of the thermal bonding step.

Tufting

A nonwoven fabric used as tuft backing was tufted as follows, using a commercially available tuft yarn.

1/10" division and velour finish in the carpet industry, in particular the automotive sector Stitch count: 56/10 cm Tuft yarn: PA6 BCF 1300 dtex f128

Tuft yarn weight: 400 g/m$^2$

The distance between the tufting needles which introduce the tuft yarn into the tuft backing, in this case the nonwoven fabric tuft backing, is expressed in fractions of an inch. Thus, 1/10" means 10 needles per 2.54 cm, i.e., a distance of 2.54 mm between the tufting needles.

The spacing of the stitches along the length of the tuft backing is referred to as the stitch length. The number of stitches is expressed per 10 centimeters, and also determines the number of loops or neps. Other tuft divisions, for example 5/32", 1/8", 5/64", 1/16", or 1/22" may also be used for manufacturing the top layers of a carpet.

A commercially available PA6 BCF 1300 dtex f128 yarn composed of polyamide 6 yarns having a titer of 1300 dtex and a composition of 128 individual filaments was used as tuft yarn. "BCF" stands for bulked continuous filament, in particular a textured continuous yarn. Other common tuft yarns may also be used.

Before the tufting needles returned, the introduced tuft yarn was secured by grippers, thus producing loops or neps on the top side of the tuft backing.

A loop-pile top layer of a carpet was produced in this manner. Cutting the loops with a blade resulted in a cut-pile or velour top layer of a carpet.

Results

The physical values obtained for a top layer of a carpet manufactured in this manner, in which the splittable fibers of the nonwoven fabric were split in the region of the puncture site after tufting, are presented below in comparison with a tufted conventional, standard nonwoven fabric (Lutradur® LDT 53 12 (Freudenberg)):

| | Top layer of carpet manufactured according to the invention | Conventional top layer of carpet, standard nonwoven fabric (Lutradur ® LDT 53 12) |
|---|---|---|
| Maximum tensile force (longitudinal) [N/5 cm] (EN 29073, Part 3) | 218 (211-225) | 287 (228-319) |
| Maximum elongation (longitudinal) [%] (EN 29073, Part 3) | 79 (78-80) | 63 (54-71) |
| Tear propagation force (longitudinal) [N] (DIN 53859, Part 3) | 295 (276-314) | 198 (185-208) |

The high elongation and tear propagation force values demonstrate that there was no damage to the nonwoven fabric fibers during tufting.

Figure 4:
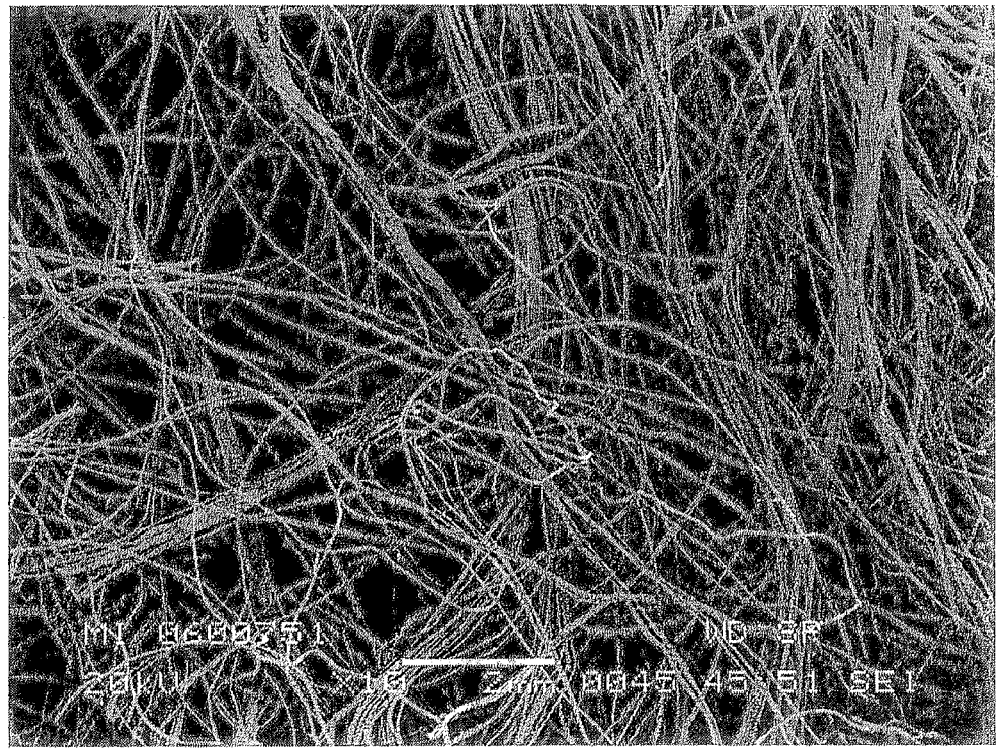
FIG. 4 shows a scanning electron micrograph of a section in 10× magnification of the surface of a top layer of a carpet manufactured according to the invention (after pulling out the tuft yarn)
Figure 6:
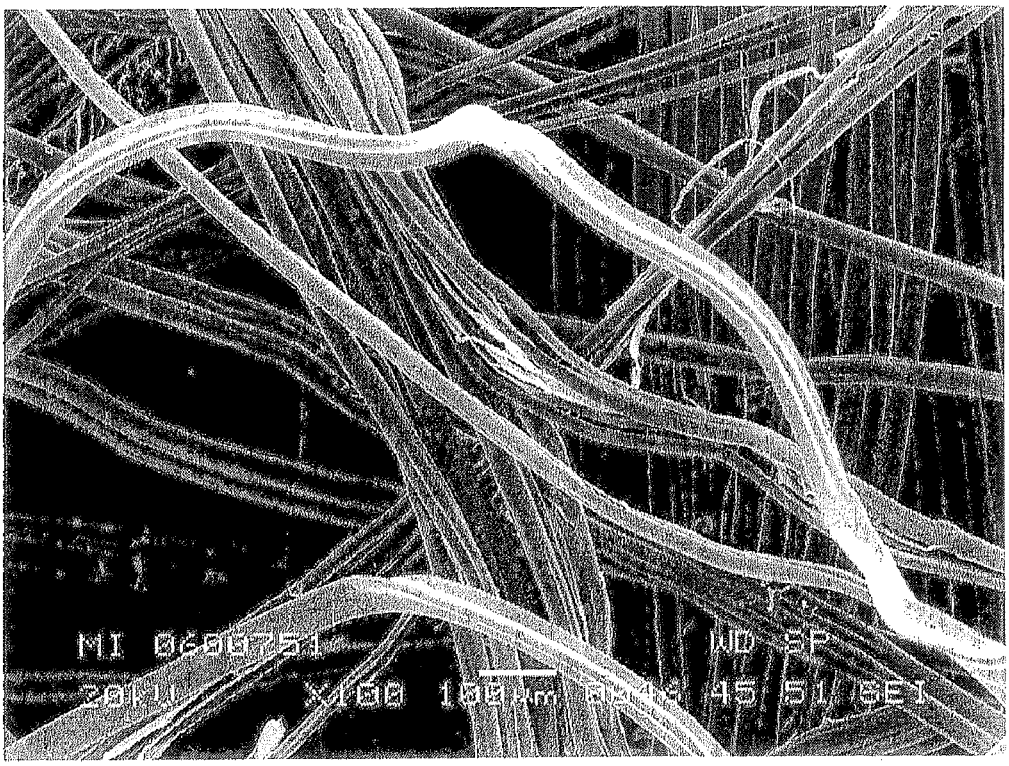
FIG. 6 shows a scanning electron micrograph of a section in 100× magnification of the surface of a top layer of a carpet manufactured according to the invention, corresponding to FIG. 4.
Figure 7:
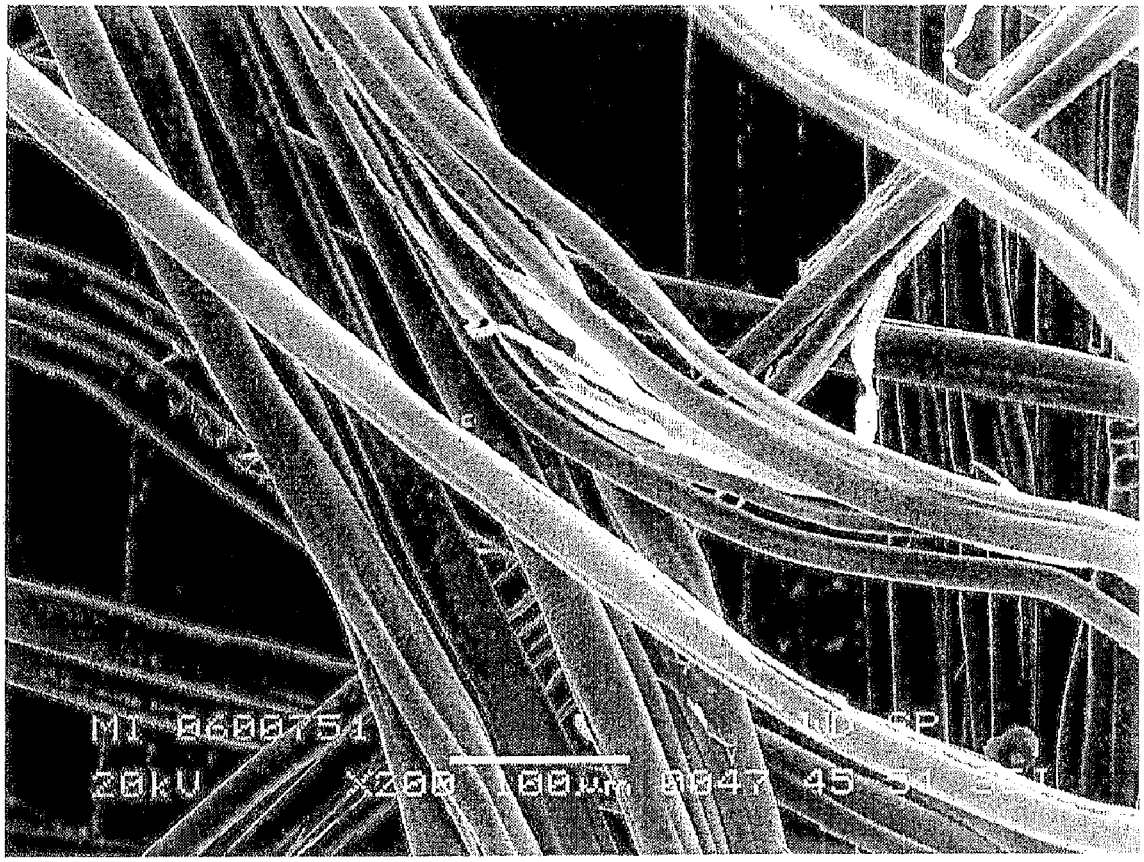
FIG. 7 shows a scanning electron micrograph of a section in 200× magnification of the surface of a top layer of a carpet manufactured according to the invention, corresponding to FIG. 6.

FIGS. 4, 6, and 7 show the surface of a tufted top layer of a carpet manufactured according to the invention, i.e., in this case by way of example a nonwoven fabric tufted under the above-referenced conditions, containing split PET/PP pie fibers after pulling out the tuft yarn, thus obtaining a free surface for the scanning electron micrographs.

Figure 3:
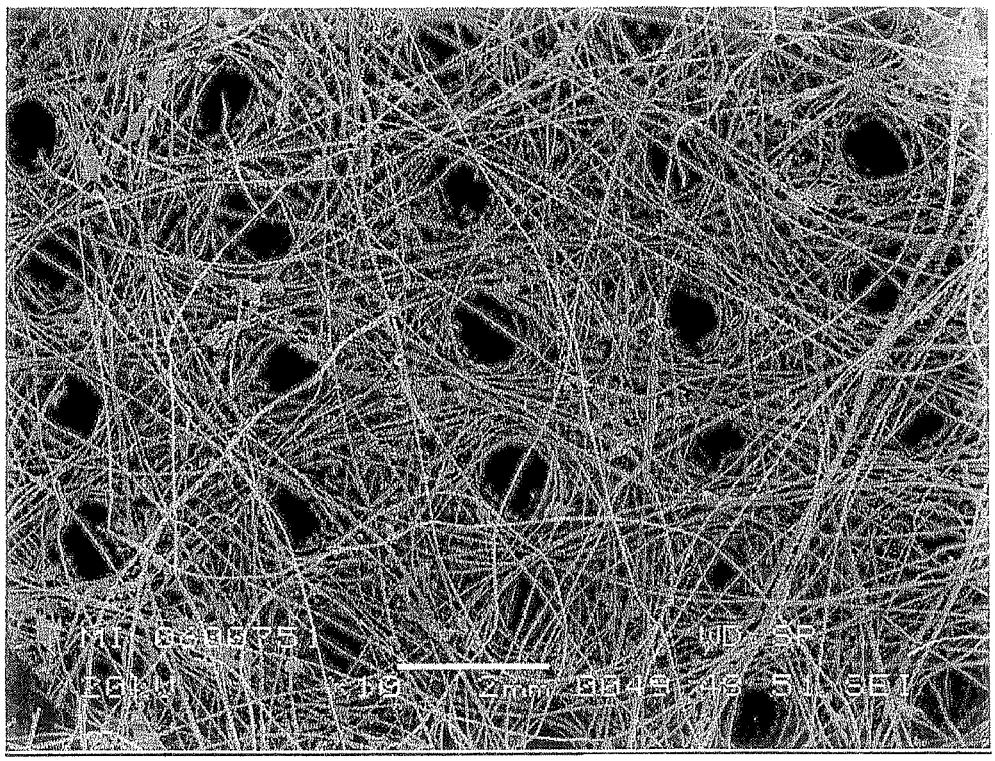
FIG. 3 shows a scanning electron micrograph of a section in 10× magnification of the surface of a conventional top layer of a carpet (after pulling out the tuft yarn)
Figure 5:
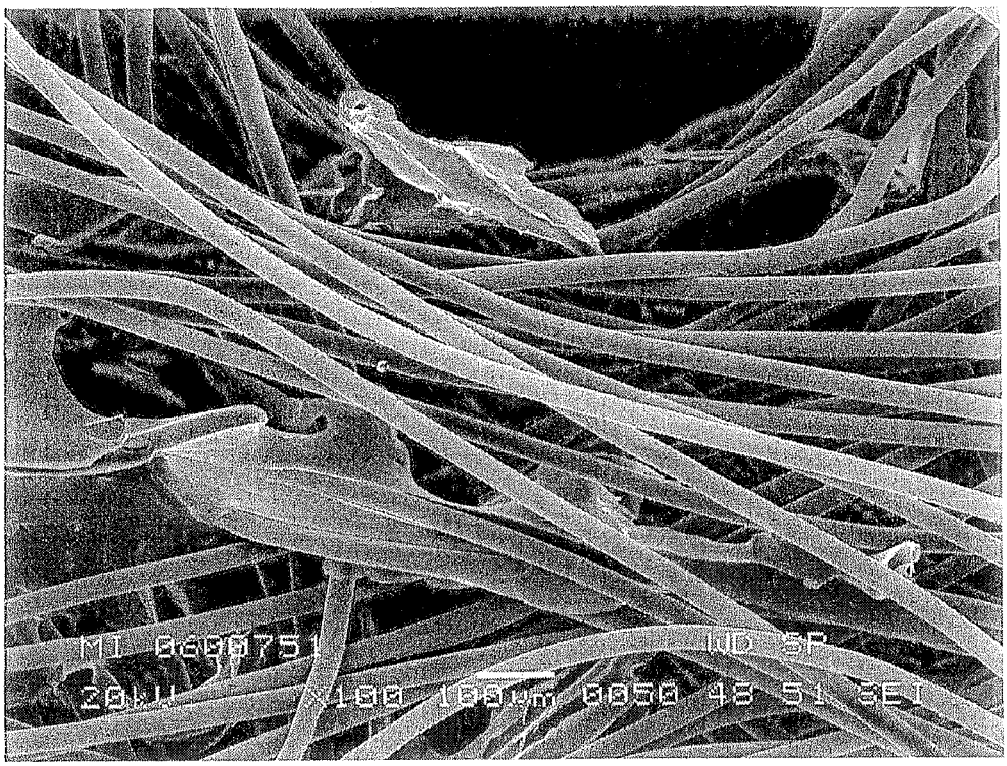
FIG. 5 shows a scanning electron micrograph of a section in 100× magnification of the surface of a conventional top layer of a carpet, corresponding to FIG. 3.

In comparison, FIGS. 3 and 5 show the surface of a conventional tufted top layer of a carpet, i.e., a tufted conventional, standard nonwoven fabric (Lutradur® LDT 53 12) containing separately spun PET and PP monofibers after pulling out the tuft yarn, thus obtaining a free surface for the scanning electron micrographs. The tufting conditions corresponded exactly to the conditions to which the nonwoven fabric containing splittable PET/PP pie fibers were subjected.

Although for tufted conventional, standard nonwoven fabric the puncture site, referred to as the tuft hole, is still very visible (FIGS. 3 and 5), the tuft holes in the tufted nonwoven fabric containing split fibers contract to form smaller tuft holes after the tuft yarn is pulled out (FIGS. 4, 6, and 7).

FIGS. 6 and 7 also show, on account of splitting in the region of the puncture site, the so-called tuft hole region, pressed-out PP fiber sections which result in a further increase in the specific fiber surface.

Because the nep adhesion is a function of the static friction between the fibers of the tuft backing, in the present case for the nonwoven fabric, and of the tuft yarn, due to the smaller contracted tuft holes and the increased specific fiber surface for the tufted nonwoven fabric containing split fibers, i.e., the top layer of a carpet manufactured according to the invention, an improved nep adhesion is expected in comparison to the tufted conventional, standard nonwoven fabric.

Measurement of Nep Adhesion

The following method was used to measure the nep adhesion:

The untufted tuft backing, i.e., the nonwoven fabric containing the splittable fibers or nonsplittable fibers, was clamped to a special holder on a tensile strain device (from Zwick) and was punctured on the back side using a single tufting needle (from Groz Beckert). The yarn (PA6 BCF 1300 dtex 128f, yarn length 400 mm), which was also used for the tufting, was threaded into the needle, pulled through the tuft backing, and attached to a very fine-resolution load cell parallel to the tuft backing.

The provided tuft yarn was then pulled through the nonwoven fabric tuft backing, and the necessary applied force was measured. The greater the force, the greater the friction between the tuft yarn and the fibers of the nonwoven fabric, and the greater the nep adhesion.

Ten measurements per material were performed, each time a defined yarn length of 400 mm being pulled through the tuft backing of the nonwoven fabric at a pulling speed of 200 mm/min. For each measurement the average value of the tensile force was determined over the 400-mm yarn length. The load cell, having a resolution of ±0.1 N, recorded a maximum value of 2 N.

Results of the Nep Adhesion Measurement

The nep adhesion measurement, using the above-referenced tuft yarn (PA6 BCF 1300 dtex 128f), gave the following results for the specific nep adhesion $N_{spec}$ [N $m^2$/g] (in accordance with EN 29073).

$N_{spec}$ (standard nonwoven fabric, Lutradur® LDT 53 12): 0.94 N $m^2$/g $N_{spec}$ (nonwoven fabric with split PET/PP pie fibers): 0.99 N $m^2$/g (with a standard deviation of 0.02 N $m^2$/g)

The measurement results confirm that the nep adhesion of the tufted nonwoven fabric containing the split fibers, i.e., the top layer of the carpet manufactured according to the invention, was improved compared to the tufted conventional, standard nonwoven fabric.

What is claimed is:

1. Method for manufacturing a tufted product, comprising:

providing a non-woven fabric having a width;

providing one or more tufting needles;

providing a tufting yarn;

introducing the tufting yarn and said one or more tufting needles along the width of the non-woven and piercing through the non-woven at one or more puncture sites to define a tuft hole;

wherein said non-woven fabric comprises bicomponent splittable fibers which are split on or in the region of the puncture site during said piercing, wherein the splittable fibers are selected from combinations of polyethylene terephthalate (PET) and polypropylene (PP), and/or polypropylene (PP) and polyethylene (PE) and wherein said tuft holes in the tufted non-woven fabric containing said split fibers contract upon removal of said tuft yarn.

2. Method according to claim 1, wherein splittable fibers are used in a proportion of 10 to 100% by weight.

3. Method according to claim 1, wherein said non-woven fibers comprise a mixture of splittable and nonsplittable fibers is used.

4. Method according to claim 1, wherein at least one of said at least two polymer components has a lower weight proportion than the other polymer component.

5. Method according to claim 1, wherein at least one of said at least two polymer components has a weight proportion of less than or equal to 20% by weight relative to the total weight of the fibers.

6. Method according to claim 1, wherein a polymer component with a lower melting temperature is used as the polymer component having a lower weight proportion.

7. Method according to claim 6, wherein at least one of said at least two polymer components having a lower weight proportion than the other polymer component, is used as adhesive or binding component, the melting temperature of said lower weight proportion polymer component being at least 10° C. below the melting temperature of the other polymer component.

8. Method according claim 3, wherein the nonsplittable fibers are selected from mono-, bi-, or multicomponent fibers, and/or from mixtures of such fibers.

9. Method according to claim 3, wherein said splittable and said non-splittable fibers are selected which have a titer in the range of 5 to 20 dtex.

10. Method according to claim 1, wherein said bicomponent splittable fibers are selected which have circular and/or noncircular cross-sectional shapes, prior to being split.

11. Method according to claim 1, wherein said bicomponent splittable fibers are selected which have a solid or hollow design, prior to be being split.

12. Method according to claim 1, wherein said bicomponent splittable fibers are used in the form of a fleece or nonwoven fabric.

13. Method according to claim 1, wherein the tufted product is subjected to heat treatment after tufting.

14. Method according to claim 1, wherein splittable fibers are used in a proportion of 100% by weight.

15. Method according to claim 1 wherein said tufting comprises tufting with tufting needles where said tufting needles are present at a level of at least 10 needles per 2.54 cm.

16. A tufted product manufactured by a method according to claim 1.

17. A tufted product, according to claim 16 provided in an automotive interior and/or in offices, hotels, airports, and/or hospitals.

* * * * *